United States Patent [19]

Syrett et al.

[11] Patent Number: 4,686,496

[45] Date of Patent: Aug. 11, 1987

[54] MICROWAVE BANDPASS FILTERS INCLUDING DIELECTRIC RESONATORS MOUNTED ON A SUSPENDED SUBSTRATE BOARD

[75] Inventors: Barry A. Syrett, Ottawa; Paul A. Kennard, Nepean, both of Canada

[73] Assignee: Northern Telecom Limited, Montreal, Canada

[21] Appl. No.: 721,092

[22] Filed: Apr. 8, 1985

[51] Int. Cl.[4] ..... H01P 1/20

[52] U.S. Cl. ..... 333/202; 333/219; 333/235; 333/251; 333/24.2

[58] Field of Search ..... 333/202, 219, 235, 251, 333/246, 24.2; 331/99, 107 DP, 107 SL, 117 D

[56] References Cited

U.S. PATENT DOCUMENTS

| | | | |
|---|---|---|---|
| 3,613,035 | 10/1971 | Askew | 333/246 |
| 3,863,181 | 1/1975 | Glance et al. | 333/251 X |
| 3,936,778 | 2/1976 | De Ronde | 333/246 |
| 4,024,478 | 5/1977 | Wolfe | 333/24.2 |
| 4,138,652 | 2/1979 | Nishikawa et al. | 333/251 |
| 4,143,344 | 3/1979 | Nishikawa et al. | 333/202 |
| 4,270,106 | 5/1981 | Woermbke | 333/251 X |
| 4,330,765 | 5/1982 | Patukonis | 333/246 |
| 4,477,785 | 10/1984 | Atia | 333/219 X |
| 4,559,490 | 12/1985 | Gannon et al. | 333/202 |
| 4,560,965 | 12/1985 | Gosling et al. | 333/219 |

FOREIGN PATENT DOCUMENTS

| | | | |
|---|---|---|---|
| 2258557 | 6/1974 | Fed. Rep. of Germany | 333/246 |
| 0039042 | 4/1978 | Japan | 333/235 |
| 0072438 | 6/1978 | Japan | 333/204 |

OTHER PUBLICATIONS

Bastida, E. M. et al; "GaAs Monolithic Circuits Mounted Over High Q resonator"; IEEE 1982 Conference on Microwave & Millimeterwave Monolithic Circuits; 18 Jun. 1982; pp.. 11-15.

*Primary Examiner*—Eugene R. LaRoche
*Assistant Examiner*—Benny T. Lee
*Attorney, Agent, or Firm*—R. John Haley

[57] ABSTRACT

A dielectric resonator microwave bandpass filter includes a printed circuit board supported within a cut-off waveguide, with dielectric resonators and coupling loops on an upper surface of the board and a well beneath the board so that the resonators are well spaced from ground planes. Tuning screws beneath the resonators, and coupling adjustment screws above the board adjacent to the coupling loops and between adjacent resonators, provide for adjustments to provide desired filter characteristics within a wide range. Isolators within the waveguide have ports coupled to the resonators via microstrip transmission lines comprising conductive tracks on the board and ports coupled to coaxial connectors in end walls of the waveguide. The waveguide is formed from a cast body and a flat lid.

20 Claims, 3 Drawing Figures

MICROWAVE BANDPASS FILTERS INCLUDING DIELECTRIC RESONATORS MOUNTED ON A SUSPENDED SUBSTRATE BOARD

This invention relates to microwave bandpass filters including dielectric resonators.

It is known for example from Nishikawa et al. U.S. Pat. No. 4,143,344 issued Mar. 6, 1979 to provide a microwave bandpass filter which is constituted by a cut-off waveguide, i.e. a waveguide whose size is too small to propagate microwaves in a desired range of frequencies, in which there are disposed a plurality of tuned dielectric resonators to provide coupling of microwaves in the desired pass band from an input coupler to an output coupler.

It is also known to provide a microwave bandpass filter in the form of an iris coupled filter which comprises a waveguide, sized for propagating microwaves in the desired pass band, which is divided into a plurality of resonant chambers by partitions across the waveguide, each partition having an aperture or iris which provides for coupling microwaves into or out of the chamber.

In order to provide a desired bandpass filter characteristic it has been determined that an n-pole filter (n being an integer) generally needs a total of $2n+1$ coupling and tuning adjustments, For a 3-pole iris coupled filter, for example, these can be readily constituted by 3 turning screws, one for each of the 3 resonant chambers of the filter, and 4 coupling screws, one for each aperture or iris. However, the iris coupled filter has the disadvantage of being of a relatively large size for microwave frequencies below about 10 GHz.

In contrast, the dielectric resonator microwave bandpass filter has a relatively smaller size due to its use of a cut-off waveguide, but known forms of this do not facilitate providing the desired number of adjustments for achieving particular characteristics.

Such microwave bandpass filters are typically used as channel filters in a multi-channel microwave radio transmitter. In such an application, each filter is typically connected between the output of a modulator and the input of a transmitting amplifier, and serves to pass only one of the two sidebands of the modulated signal for transmission. Connection to an iris coupled filter is conveniently effected by coaxial cable via an isoadapter, which is a combined isolator and waveguide/-coaxial cable adapter, but this adds further to the large size of the filter. Coupling to a dielectric resonator filter can be effected in the same manner with the same disadvantage of large size, or can be effected by coaxial cable with the disadvantage of requiring an isolator to be separately provided.

Microwave bandpass filters are also used as branching (channel combining and channel dropping) filters in microwave radio transmission systems. In such a case each filter conveniently has a coaxial connection at one port for coupling to a transmitting or receiving amplifier, and a waveguide coupling at the other port for connection to a circulator and thence to a transmitting or receiving antenna.

An object of this invention, therefore, is to provide an improved microwave bandpass filter.

According to this invention there is provided a microwave bandpass filter comprising: a waveguide of rectangular cross-section having conductive upper, lower, and side walls; an insulating board in the waveguide having upper and lower surfaces substantially parallel to and spaced from the upper and lower walls the lower and side walls defining a well beneath the board and supporting the board around substantially its entire periphery; a plurality of dielectric resonators supported by the board and spaced along the waveguide; a plurality of tuning screws each extending through the lower wall into the well beneath a respective one of the dielectric resonators; and means for coupling microwave signals to and from the resonators.

The board preferably includes on its lower surface a ground plane conductor in regions where the board is supported, the ground plane being soldered to the walls to fix the board in position.

Dielectric resonators are preferably supported above the board. Electrically conductive spurious mode suppressors preferably extend from the lower wall through the board substantially perpendicularly thereto each between two adjacent resonators. In addition, coupling adjustment screws advantageously extend through a side wall of the waveguide above the board each between the two adjacent resonators for varying the coupling therebetween. For example, there may be three resonators and two such coupling adjustment screws.

Preferably each means for coupling microwave signals to or from a resonator comprises a coupling conductor on the board extending adjacent to the periphery of the resonator, each coupling conductor conveniently being on the upper surface of the board and having an unconnected end adjacent to a side wall of the waveguide. In this case coupling adjustment screws preferably also extend through the side wall above the board each adjacent to the unconnected end of a respective coupling conductor for varying the coupling between this conductor and the respective resonator.

The filter preferably also includes within the waveguide at least one isolator having a port coupled to a respective means for coupling microwave signals to or from a resonator. Conveniently each respective means for coupling microwave signals to or from a resonator which is coupled to an isolator port comprises a microstrip transmission line, comprising a conductor and a ground plate on opposite surfaces of the board, having a characteristic impedence matched to that of the isolator. In this manner impedence matching and a compact isolator and filter arrangement are readily achieved.

For coupling coaxial cables to the filter and isolator arrangement, preferably there are two isolators and the waveguide includes two end walls each including a respective coaxial connector having a central connection extending through the end wall and coupled to a second port of a respective isolator.

The waveguide conveniently comprises a body constituting the lower and side walls and a flat lid constituting the upper wall, and means for securing the lid to the body.

The invention will be further understood from the following description with reference to the accompanying drawings, in which.

Figures 1, 2, 3:
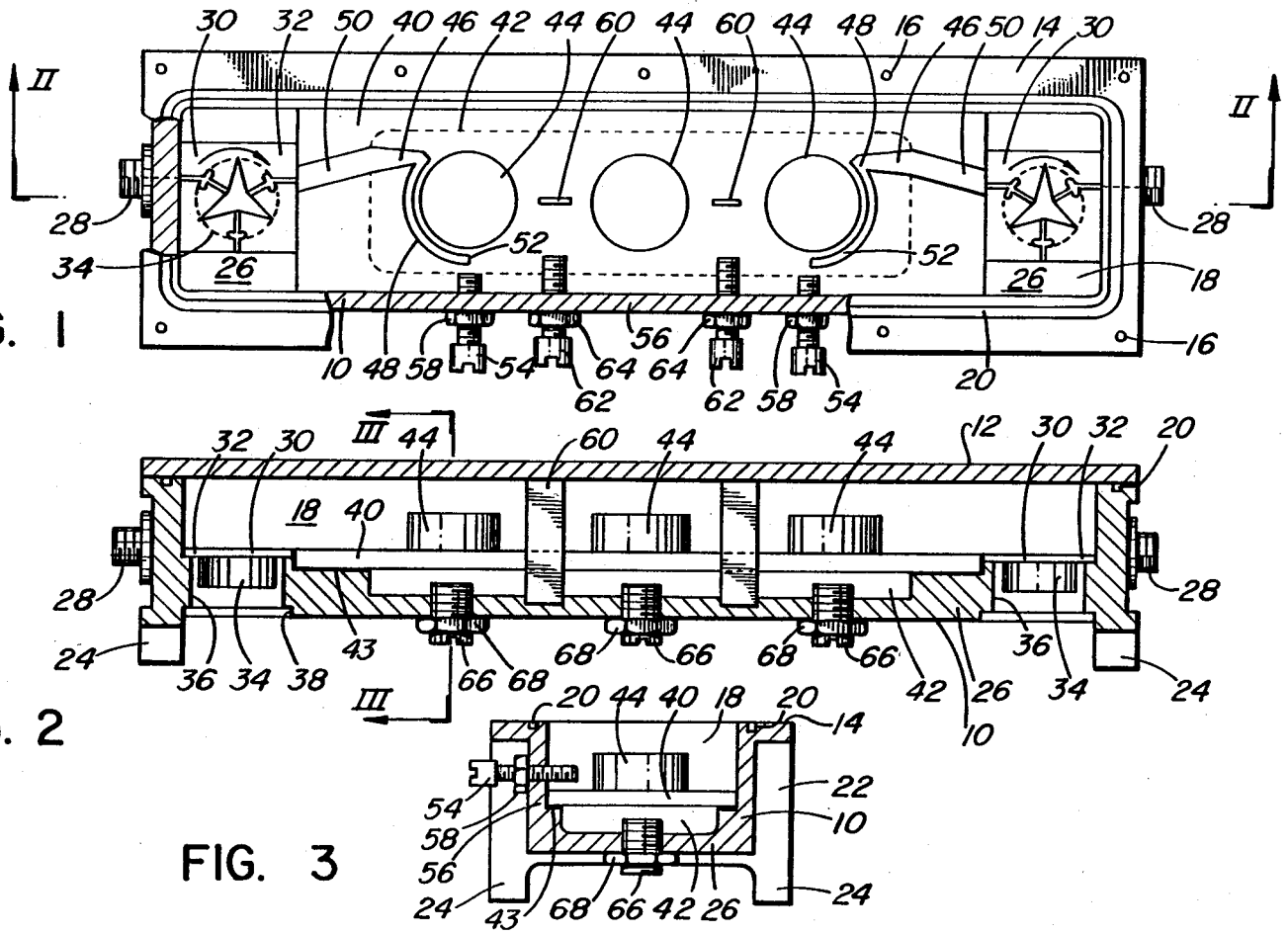
FIG. 1 is a partly cut-away plan view of a dielectric resonator microwave bandpass filter, with a lid thereof removed, in accordance with an embodiment of the invention.
FIG. 2 is a longitudinal sectional illustration of the filter of FIG. 1, the section being taken on the lines II—II in FIG. 1.
FIG. 3 is a cross sectional illustration of the filter, the section being taken on the lines III—III in FIG. 2.

Referring to the drawings, the filter illustrated therein comprises a metal enclosure, forming a cut-off waveguide, formed by an elongate body 10 and a flat lid 12 which is shown only in FIG. 2. The body 10 is for example formed by investment casting, and subsequent machining where necessary, from an alloy comprising 83% copper, 7% lead, 7% tin, and 3% zinc. The body 10 has a top flange 14 along the length of each side, in which are formed a plurality of threaded holes 16 into which are screwed screws (not shown) which pass through corresponding holes (not shown) in the lid 12 to secure the lid to the body 10. In FIG. 1 the top flange 14 is illustrated as being cut-away in parts to show details beneath it.

The body 10 includes an elongate cavity 18 which is described in detail below. In the top flange 14 and immediately surrounding the entire periphery of the cavity 18 and the body 10 includes a continuous groove 20 in which a continuous wire mesh filament (not shown) is secured to provide an electro-magnetic seal between the body 10 and the lid 12.

The body 10 also has at each end a flange 22 which is shaped as is best shown in FIG. 3 to form feet 24 on which the filter stands in use, so that a lower surface of the base 26 of the body 10 is supported above the surface on which the filter stands, in order to facilitate adjustment of tuning screws described below.

The filter in this embodiment of the invention is intended to be connected between two coaxial cables, to which end a coaxial cable connector 28 is mounted externally on each end flange 22, a central pin of each connector 28 passing through an aperture in the end flange 22, as shown by broken lines in FIGS. 1 and 2, to the end of the cavity 18 where it is electrically connected to one port of a respective one of two isolators 30. As is best shown in FIG. 2, each isolator is a known form of so-called drop-in isolator which comprises a metallized ferrite substrate 32 and a cylindrical permanent magnet 34 supported therefrom. The ferrite substrate 32 is supported by and has on its underside a ground plane which is soldered to the base 26 of the body 10, through which there is provided a cylindrical aperture 36 to accomodate and provide access to the permanent magnet 34. Each aperture 36 has a counterbore 38 at the lower surface of the base 26 to accomodate a metal cap (not shown) for electro-magnetically sealing this aperture.

Between the isolators 30 there extends a printed circuit board 40 preferably of polyetherimide material, such as that marketed by the General Electric Company under the trade name "Ultem", which is physically and thermally stable. In this respect it is observed that other materials could be used, but PTFE, which is commonly used for printed circuit boards, is preferably not used because it has a discontinuity in its expansion-temperature characteristic at a temperature of about 25° C. and hence lacks thermal stability. For physical stability the board 40 is relatively thick compared with, for example, the substrates 32. In consequence, the upper surface of the base 26 of the body 10 is stepped, at the point where each substrate 32 and the board 40 meet, so that their upper surfaces are in the same plane. The coaxial cable connectors 28 are positioned so that their central pins are also in this same plane, so that electrical connections to the ports of the isolators are readily achieved by solder bridges between the abutting contacts.

As indicated by a broken line in FIG. 1, a well 42 is formed in the base 26 of the body 10 beneath the board 40. The board 40 is supported at its ends, beyond the ends of the well 42, by the base 26 as shown in FIG. 2, and is supported along the lengths of its sides, beyond the sides of the well 42, by stepped sides of the base 26 as shown in FIG. 3. In these support regions the board 40 has on its lower surface a ground plane 43 which is soldered to the base 26 to secure the board 40 in place. The ground plane does not extend into the region of the well 42.

Three dielectric resonators 44 are glued to the upper surface of the board 40 to form in this case a 3-pole bandpass filter. The form and selection of dielectric resonators to form bandpass filters is generally known and need not be described here. It is noted, however, that the dielectric resonators 44 are positioned above the region of the well 42, so that there is no ground plane close to the resonators. The distance between the resonators and the nearest ground plane, which is greatly increased by the provision of the well 42, maintains the high quality factor of the dielectric resonators and considerably facilitates tuning of the resonators over a relatively wide frequency range as is described further below.

For coupling microwave frequency signals between each of the isolators 30 and the respective dielectric resonator 44 which is nearest to it, conductive tracks 46 are provided on the upper surface of the board 40. Each track 46 comprises a coupling loop 48 which extends above the well 42 part of the way around the periphery of the respective resonator 44, a relatively wide track 50 which extends above the ground plane on the lower surface of the board 40 and forms a microstrip transmission line, and a tapered portion which couples the microstrip transmission line to the coupling loop. Each track 50 has a width which is selected to provide a 50 ohm characteristic impedence to match the characteristic impedence, also 50 ohms, of the isolator 30 and coaxial cable to be connected to the connector 28. Each track 50 is electrically connected to a second port of the respective isolator 30; a third port of each isolator 30 is terminated with a resistance of 50 ohms within the isolator itself.

The width of the track forming each coupling loop, its spacing from the periphery of the dielectric resonator 44 to which it couples, the angle which this loop subtends at the axis of this resonator, and the distance of the loop (and hence the resonator) from the edge of the well 42 are all selected to optimize the matching and coupling between the microstrip connector and the resonator, for the desired pass band of the bandpass filter. In any event, each coupling loop 48 is arranged so that its unconnected end 52 is at one side of the dielectric resonator, as shown in FIG. 1. A respective screw 54 extends through a threaded hole in the side wall 56 of the body 10 above the board 40 into proximity with each end 52 and the associated resonator 44, and serves for adjusting the coupling of the loop 48 to the resonator 44. Turning the screw 54 to be closer to the resonator 44 increases the coupling by increasing the fringing capacitance associated with the loop end 52. A locking nut 58 on each screw 54 enables the screw to be fixed in position after it has been appropriately adjusted.

Between the central one of the three dielectric resonators 44 and each outer one of these resonators 44 there is provided an electrically conductive upright bar 60 which constitutes a spurious mode suppressor. As is best shown in FIG. 2, each bar 60 extends from a respective recess in the base 26 of the body 10, to which it is thereby electrically connected, upwardly through an aperture in the board 40 positioned mid-way between the dielectric resonators 44 on each side of it, to the vicinity of the lid 12. The bars 60 serve to suppress the propagation of spurious modes of the microwave signals through the filter in a manner known for example from Nishikawa et al. U.S. Pat. No. 4,138,652 issued Feb. 6, 1979.

Two screws 62 extend through threaded holes in the side wall 56 of the body 10 above the board 40, one opposite each of the bars 60, and enable adjustment of the coupling which is achieved between adjacent pairs of the resonators 44. Lock nuts 64 on these screws 62 enable them to be fixed in position after they have been appropriately adjusted to achieve desired degrees of coupling.

As shown in FIGS. 2 and 3, centrally beneath each dielectric resonator 44 there is a tuning adjustment screw 66 which extends through a respective threaded hole in the base 26 of the body 10 into the well 42 below the board 40 to permit tuning of the resonators 44. A respective locking nut 68 on each of the three screws 66 enables the screw to be fixed in position after tuning.

The bandpass filter described above provides numerous advantages and conveniences over known filters. For example, it has a relatively small size due to the use of dielectric resonators and a cut-off waveguide, and the incorporation of the isolators 30 within the body 10. The use of the flat lid 12 is a convenience in manufacture, and because this lid 12 does not incorporate any adjusting screws it can be removed and replaced without disturbing tuning and coupling adjustments.

The provision of the well 42 increases the distances between the resonators 44 and ground planes, thereby maintaining the high quality factor of the dielectric resonators and facilitating adjustment of the filter for particular characteristics within relatively wide ranges. The positioning of the tuning screws 66 below the board 40 and below the resonators 44, and the coupling adjustment screws 54 and 62 above the board 40 and at one side of the resonators 44, provides a substantial degree of independence of the tuning and coupling adjustments, so that the coupling and tuning adjustments do not mutually and adversely affect one another to a large extent. It should be noted that the 4 coupling adjustment screws and the 3 tuning screws provided the desired total of 7 adjustments for the described 3-pole filter.

Although the above description relates to a filter incorporating isolators and for coupling between two coaxial cables, it should be appreciated that at one or both ends of the filter the isolator could, if desired, be omitted, and/or coupling may be effected in known manner to a waveguide rather than to a coaxial cable connector. It should also be appreciated that the microstrip connector formed by the track 50 may be modified or replaced by other suitable forms of coupling.

These and numerous other modifications, variations, and adaptations may be made to the particular bandpass filter described above without departing from the scope of the invention, which is defined by the claims.

What is claimed is:

1. A microwave bandpass filter comprising:

a waveguide of rectangular cross-section having conductive upper, lower, and side walls;

an insulating board in the waveguide having upper and lower surfaces substantially parallel to and spaced from the upper and lower walls, the lower and side walls defining a well beneath the board and supporting the board around substantially its entire periphery;

a plurality of dielectric resonators supported by the board and spaced along the waveguide;

a plurality of tuning screws each extending through the lower wall into the well beneath a respective one of the dielectric resonators; and means for coupling microwave signals to and from the resonators, each means for coupling microwave signals comprising a coupling conductor on the board directly over the well adjacent to a periphery of a respective resonator.

2. A filter as claimed in claim 1 wherein the board includes on its lower surface a ground plane conductor in regions where the board is supported.

3. A filter as claimed in claim 2 wherein the ground plane conductor is soldered to the walls.

4. A filter as claimed in claim 1 wherein the dielectric resonators are supported on the upper surface of the board.

5. A filter as claimed in claim 1 wherein there are three dielectric resonators.

6. A filter as claimed in claim 1 and including at least one electrically conductive spurious mode suppressor extending from the lower wall through the board substantially perpendicularly thereto between two adjacent dielectric resonators.

7. A filter as claimed in claim 1 and including at least one coupling adjustment screw extending through a side wall of the waveguide between two dielectric resonators for varying the coupling therebetween.

8. A filter as claimed in claim 7 wherein each coupling adjustment screw extends through the side wall above the board.

9. A filter as claimed in claim 8 wherein the dielectric resonators are supported on the upper surface of the board.

10. A filter as claimed in claim 1 wherein each coupling conductor includes an unconnected end adjacent to a side wall of the waveguide.

11. A filter as claimed in claim 10 and including at least one coupling adjustment screw extending through the side wall of the waveguide adjacent to the unconnected end of a respective coupling conductor for varying the coupling between the coupling conductor and the dielectric resonator.

12. A filter as claimed in claim 11 wherein each coupling conductor is on the upper surface of the board and each coupling adjustment screw extends through the side wall above the board.

13. A filter as claimed in claim 12 wherein the dielectric resonators are supported on the upper surface of the board.

14. A filter as claimed in claim 13 and including at least one coupling adjustment screw extending through a side wall of the waveguide above the board between two adjacent dielectric resonators for varying the coupling therebetween.

15. A filter as claimed in claim 1 and including in the waveguide at least one isolator having a port coupled to a respective means for coupling microwave signals.

16. A filter as claimed in claim 15 wherein each respective means for coupling microwave signals which is coupled to an isolator port comprises a microstrip transmission line, comprising a conductor and a ground plane on opposite surfaces of the board, having a characteristic impedence matched to a characteristic impedence of the isolator.

17. A filter as claimed in claim 15 wherein the waveguide includes at least one end wall including a coaxial connector having a central connection extending through the end wall and coupled to a second port of a respective isolator.

18. A filter as claimed in claim 17 wherein the waveguide includes two end walls each including a respective coaxial connector, wherein there are two isolators each coupled bewteen a respective coaxial connector and a respective means for coupling microwave signals.

19. A filter as claimed in claim 1 wherein the waveguide comprises a body constituting the lower and side walls and a flat lid constituting the upper wall, and means for securing the lid to the body.

20. A filter as claimed in claim 1 wherein the board comprises polyetherimide material.

* * * * *